US005462276A

United States Patent [19]

Kaminkow

[11] Patent Number: 5,462,276

[45] **Date of Patent: * Oct. 31, 1995**

[54] MOVEABLE ARM AND INSERTS FOR AMUSEMENT DEVICE

[76] Inventor: Joseph E. Kaminkow, 1304 Meade La., Arlington Heights, Ill. 60004

[ * ] Notice: The portion of the term of this patent subsequent to Jul. 19, 2011, has been disclaimed.

[21] Appl. No.: 220,614

[22] Filed: Mar. 31, 1994

Related U.S. Application Data

[62] Division of Ser. No. 120,123, Sep. 10, 1993, Pat. No. 5,330,182.

[51] Int. Cl.[6] ..... A63F 7/36

[52] U.S. Cl. ..... 273/108; 273/118 R; 273/118 A; 273/121 R; 273/121 A

[58] Field of Search ..... 273/108, 109, 273/110, 111, 118–126; 446/149, 151; 40/414, 415

[56] References Cited

U.S. PATENT DOCUMENTS

| | | | |
|---|---|---|---|
| 2,988,845 | 6/1961 | MacDougall et al. | 446/151 X |
| 3,256,634 | 6/1966 | Mace | 446/151 X |
| 4,055,342 | 10/1977 | Matsumoto | 273/123 R X |
| 4,840,375 | 6/1989 | Lawlor et al. | 273/719 A X |
| 4,848,748 | 7/1989 | Krutsch | 273/121 E |

*Primary Examiner*—Raleigh W. Chiu
*Attorney, Agent, or Firm*—Gerstman, Ellis & McMillan, Ltd.

[57] ABSTRACT

An amusement device has a playfield and a backboard display. The display comprises a display wall having a first image carried thereon, plus a transparent display wall portion. A rotatable arm is positioned behind the transparent display wall portion. The arm is decorated to form an integral part of the first image. For example, the first image may be a cartoon character or other entertainment figure, with the arm depicting an actual arm or leg of the figure and pivotally connected at the shoulder or hip of the first image. Thus, an illusion of image movement can be provided as the arm rotates, typically in response to a predetermined event taking place on the playfield. One or more second images may be carried on one or more panels. The panels are moved between a first position behind the first image and a second position behind the transparent display wall portion. This movement may be coordinated with the motion of the arm.

5 Claims, 1 Drawing Sheet

MOVEABLE ARM AND INSERTS FOR AMUSEMENT DEVICE

This is a division of application Ser. No. 08/120,123, filed Sep. 10, 1993, U.S. Pat. No. 5,330,182.

BACKGROUND OF THE INVENTION

In amusement devices such as pinball machines, a major factor in the popularity is the variety of play found therein, plus novel actions and features.

By this invention, an image which may be largely painted or printed on a backboard may have one or more moveable portions such as a moveable arm, which may interact with other moveable portions, which are preferably variable and different as the play proceeds. Thus, the moveable arm and the associated parts may provide differing displays depending upon events taking place in the game, to increase the variety and interest in the game.

DESCRIPTION OF THE INVENTION

In this invention, an amusement device is provided having a playfield and a backboard display. The display comprises a display wall having a first image carried thereon, typically in painted or printed manner. Additionally, the display wall comprises at least one transparent display portion, or which may also be an aperture in the display wall.

A rotatable arm is positioned behind the transparent display wall portion, the arm being decorated by appropriate shape, and painting or printing, to form an integral part of the first image. Specifically, the rotatable arm may be the arm, a leg, etc. of an image of a real or cartoon character, where at least some of the remainder of the character is painted or printed on the display wall. Thus, an illusion of image movement can be provided as the arm rotates, so that the character appears to be moving. The term "arm" is intended to include essentially any member including objects held in the hand, etc.

It is also preferable for a second image to be carried on a panel. Means are provided for moving the panel between a first position behind the first image (which may include more than the image of the particular character discussed above), and a second position behind the transparent display wall portion. Thus, when the panel is in its position behind the first image, it is typically invisible, or at least of restricted visibility. When the panel is moved to its position behind the transparent display wall portion, it becomes completely visible. Means are provided for coordinating the motion of the arm and panel. For example, the arm may connected to the panel, or it be positioned to appear to be grasping the top of the panel being actually connected thereto. The arm may rest on the panel, and may thus be coordinated to move together with the panel, to provide the illusion that the arm is raising the panel.

If the arm is not actually connected to the panel, it becomes possible to have a plurality of second images which are respectively carried on a plurality of panels, the panels being stacked closely together in typical embodiments. Means may be provided for separately and alternatively moving the panels in such coordinated motion with the arm, with the arm typically resting on the panels and rotating with any moving panel.

Thus the rotating arm appears to be lifting and lowering different images between a visible and an invisible position, with the different images being thus displayed, possibly in an unexpected manner to the user.

The means for separately and alternatively moving the panels may comprise separate levers which are respectively attached to the panels. Means may then be provided for separately moving the levers responsive to different events taking place in the amusement device.

DESCRIPTION OF SPECIFIC EMBODIMENT

Figure 1:
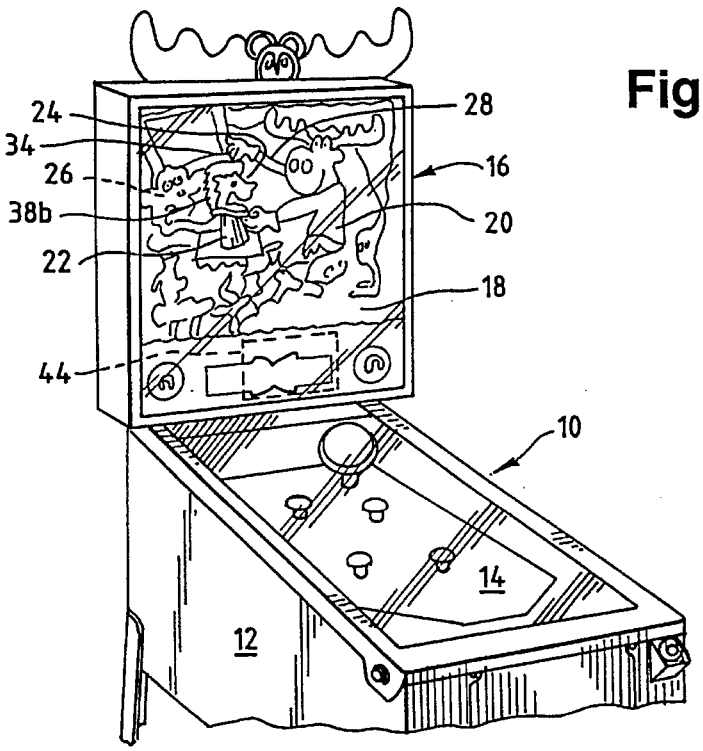
FIG. 1 is a perspective view of a pinball machine including the invention herein.
Figure 3:
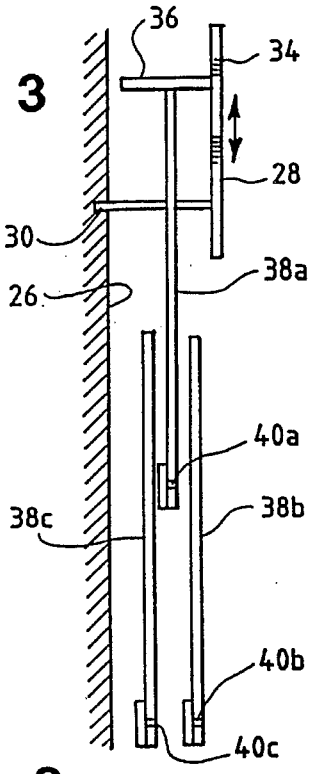
FIG. 3 is a sectional view taken along line 3—3 of FIG. 2.

Referring to the drawings, pinball game 10 comprises a frame 12 having a playfield 14 and a backboard 16 in conventional manner. Backboard 16 comprises displays and scoring units of various kinds, having a display wall 18 that is typically made of glass, having a painted or printed FIG. 20 thereon of a cartoon character or some other entertainment personage.

In this specific embodiment, FIG. 20 is shown to be holding a silk hat 22 in the manner of a magician. FIG. 20 and its hat 22 are opaque, so that objects behind them are not normally visible to the player. However, an area 24 to the left of FIG. 20 and above hat 22 is transparent, so that the first image as described above comprises FIG. 20 and hat 22, while the transparent display wall portion comprises area 24.

Behind display wall 18 is a vertical surface 26 which may also carry images as desired, which are visible through transparent area 24 and any other transparent areas present. Between display wall 18 and surface 26 is a rotatable arm 28 which is painted or printed and positioned to appear as a body arm of FIG. 20. Arm 28 is carried in free-moving, pivotal relation on pivot 30, which is carried on surface 26. Pivot 30 is typically positioned to be invisible behind FIG. 20, but in the vicinity of the shoulder of the figure, so that arm 28 moves with fairly realistic motion relative to FIG. 20. Thus the illusion of image movement is provided as arm 28 rotates.

As an added feature of this invention, arm 28 defines fingers 34 which may be lowered by arm rotation to a position at the upper edge of hat 22, and then raised to an upper position as shown in FIG. 1. Horizontal spacer rod 36 is present to provide apparent contact between the fingers 34 of arm 28 and a plurality of panels 38*a–c*, which are closely positioned together in a horizontal stack so that horizontal spacer rod 36 is in contact with an upper edge of each of the panels 38. The upper half of each of the panels 38 carries an image of a cartoon figure or the like, each of the panel images being different from the other.

Each panel 38*a–c* is also connected adjacent its bottom edge to a lever arm 40*a–c* so that each panel 38 may be individually raised from a position below the upper edge of hat 22 where its visibility is blocked by the hat, to a position above hat 32 where it becomes visible in transparent area 24 as one of the lever arms 40 raises its associated panel 38. Arm 28 is correspondingly raised because of its contact with the panel through spacer rod 36.

Thus, arm 28 may freely rotate upwardly with panel, and then downwardly again as the panel is lowered by its lever arm 40, with contact between arm 28 and the raised panel 38 being simply by the weight of pivoting arm 28.

Solenoids 42 are provided to rotate the respective lever arms 40 in a manner responsive to signals from microprocessor 44, which monitors and controls game action on playfield 14. Each lever arm 40 rotates about a pivot 45. Lever arms 40 connect with panels 38 with a horizontal sliding connection 47, with the respective connections being horizontally spaced from each other to avoid mutual interference and to permit panels 38 to be horizontally stacked closely together.

Figure 2:
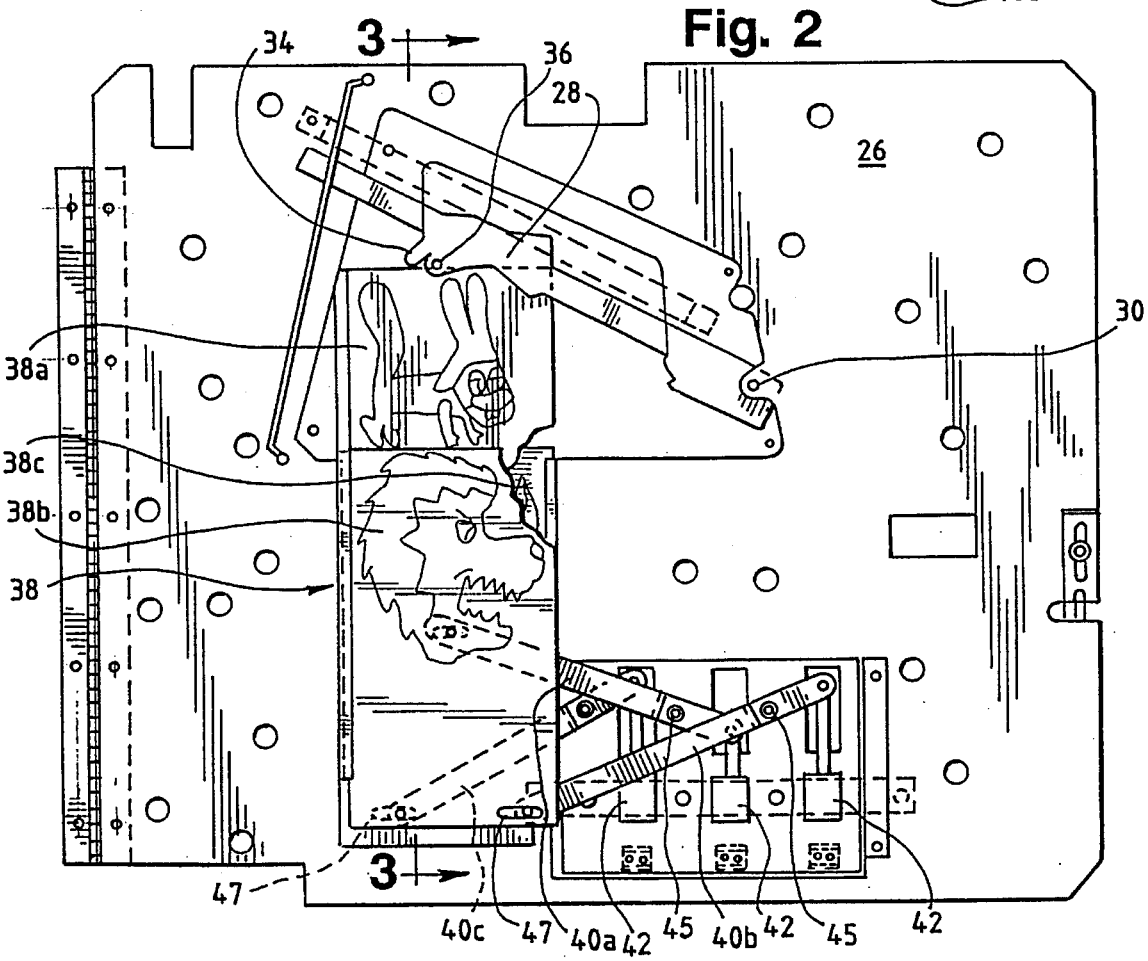
FIG. 2 is a fragmentary elevational view, with parts removed, showing the mechanism of the invention.

During game operation, if a particular score or the like is achieved by a pinball, microprocessor 44 can signal a solenoid 42 to raise a panel, e.g. panel 38*a* through lever arm 40*a*, as particularly shown in FIG. 2. As this happens, arm 28 moves, lifted by panel 38*a*, giving the illusion that FIG. 20 is raising its arm 28, to lift the image carried on panel 38*a* out of hat 22, in the manner of a magician.

Panel 38*a* may then be retracted by the action of solenoid 42 on lever arm 40*a*. Then, with another event taking place on the playfield such as a ball striking a particular target, or the same target a second time, a solenoid 42 may be impelled by microprocessor 44 to raise panel 38*b* by the action of lever arm 40*b*. Once again, since spacer rod 36 also rests on top of panel 38*b*, arm 28 is again raised, giving the illusion that FIG. 20 is raising another character out of the hat 22.

A third panel 38*c* with its different image, for example a rhinoceros, may be raised by lever arm 40*c* upon appropriate signal from the microprocessor 44 to the appropriate solenoid 42.

Thus, by this invention a new form of play action is provided, adding variety and unexpected results to the game play in a manner which may be controlled by the program of the game.

The improved display of this invention may of course be used in conjunction with other known features and functions of pinball games and other amusement devices.

The above has been offered for illustrative purposes only, and is not intended to limit the scope of the invention of this application, which is defined in the claims below.

That which is claimed is:

1. An amusement device having a playfield and a backboard display, said display comprising a display wall having a first image carried thereon plus a transparent display wall portion; a moveable arm positioned behind said transparent display wall portion, said arm being decorated to appear as part of said first image, whereby an illusion of image movement can be provided as the arm moves, said arm being moveable in response to a predetermined event taking place on the playfield.

2. The amusement device of claim 1 in which a second image is carried on a panel, and said panel is moveable between a first position behind said first image and a second position behind said transparent display wall portion, and the motions of said arm and panel are coordinated.

3. The amusement device of claim 2 in which a plurality of said second images are respectively carried on a plurality of said panels, and said panels are separately and alternately moved in coordinated motion with said arm.

4. The amusement device of claim 3 including means for separately and alternatively moving said panels comprising separate levers respectively attached to said panels, and including means for separately moving said levers responsive to different events taking place in said device.

5. The amusement device of claim 4 in which said arm is freely rotatable and rests on said panels, to be moved with said moving panels.

* * * * *